United States Patent [19]

Moser et al.

[11] 4,147,399

[45] Apr. 3, 1979

[54] FLAT CABLE CONNECTOR ASSEMBLY

[75] Inventors: Jessie L. Moser, High Point; John R. Shoemaker, Reidsville, both of N.C.

[73] Assignee: AMP Incorporated, Harrisburg, Pa.

[21] Appl. No.: 874,284

[22] Filed: Feb. 1, 1978

[51] Int. Cl.[2] ..... H01R 13/38

[52] U.S. Cl. ..... 339/99 R; 339/176 MF

[58] Field of Search ..... 339/97 R, 97 P, 98, 339/99 R, 176 MF

[56] References Cited

U.S. PATENT DOCUMENTS

| | | | |
|---|---|---|---|
| 3,760,335 | 9/1973 | Roberts | 339/99 R |
| 3,920,301 | 11/1975 | Roberts et al. | 339/99 R |

*Primary Examiner*—Joseph H. McGlynn

*Attorney, Agent, or Firm*—Gerald K. Kita

[57] ABSTRACT

This invention relates to electrical connectors for flat cable and more particularly to an electrical connector assembly having fanned out circuit traces for connection to flat cable conductors.

4 Claims, 11 Drawing Figures

FLAT CABLE CONNECTOR ASSEMBLY

BACKGROUND OF THE ART

The connection of flat cable conductors in a connector is shown generally in U.S. Pat. Nos. 4,026,625; 3,920,301; 3,950,070; and 4,005,921. None of the connectors are suitable for connection to flat cable conductors having different centerline spacing. As shown in U.S. Pat. No. 3,835,445 flat cable conductors can be spatially rearranged on different centerlines by a process known as fanning out. That is, the conductors themselves are reorineted to diverging configurations. Fanning out also may be accomplished on a paddle card to which the cable conductors are soldered. As shown in U.S. Pat. No. 3,740,698, such a card has diverging or fanned out circuit traces which lead from the cable conductors to an edge of the card which is plugged into a connector. The card is relatively large since the circuit paths as well as the connections to the card must be spatially distributed over the broad surface of the card. Some type of connector must be used which covers and protects the circuit traces and also the connections which join the cable conductors to the card. Two cables can not be joined end to end if they are provided with paddle cards. Instead, a connector which accepts cards into opposite sides is required.

SUMMARY OF THE INVENTION

The present invention achieves fanning out of circuit traces originating from flat cable conductors, without a paddle card and without a need for physically rearranging the conductors themselves.

According to the invention, two flat metal strips are stamped and formed into fanned out, strip circuit traces. The circuit traces are assembled to a rigid dielectric fixture. In the fixture, the circuit traces are oriented in two parallel planes. The fixture interlocks with an electrical connector of a type disclosed in U.S. Pat. Nos. 3,920,301 and 3,760,335, with contacts of the connector being electrically interconnected with the circuit traces. The two planes of fanned out circuit traces protrude from an end of the fixture-connector assembly and are shaped with insulation piercing electrical contacts. The contacts pierce through the cable insulation for connection to the cable conductors anywhere along the length of the cable. The cable conductors are effectively fanned out by the circuit traces and are perpendicular to the two planes of the circuit traces. The connector thereby is mounted perpendicular to the surface of the cable at any desired location along the length thereof.

The contacts of the connectors have been designed for connection to insulation sheathed wires, the contacts slicing through the insulation sheath and gripping the diametrical cross section of the wires. U.S. Pat. No. 3,920,301 discloses that flat cable conductors can be connected in the contacts so long as the conductors are shimmed by wedges which simulate the bulkiness of wire cross sections. The present invention connects the circuit traces to the connector contacts without the need for simulating bulkiness of wire cross section.

OBJECTS

An object of the present invention is to provide a connector assembly for flat cable which achieves fanning out of circuit traces without a need for a paddle card and without physically rearranging the cable conductors.

Another object of the present invention is to provide a connector assembly for flat cable which includes metal strip conductors which pierce the cable for connection to the cable conductors and which fan out and connect to contact terminals of the wire receiving type and contained in a connector, the strip conductors being connected to such contacts without the need for simulating the bulkiness of wires within the contacts.

Another object is to provide a connector assembly for flat cable which includes fanned out circuit traces which pierce the cable for direct connection to the cable conductors at any disired length along the cable.

Another object is to provide a connector assembly for flat cable which includes two planes of fanned out circuit traces which pierce the cable for direct connection to the cable conductors, and which mount an electrical connector perpendicular to the surface of the cable at any desired location along the cable length.

Other objects and advantages of the present invention will become apparent from the following detailed description taken in conjunction with the drawings.

FIG. 5 is a section taken along the lines 5—5 of FIG. 4.

DETAILED DESCRIPTION

Figure 1:
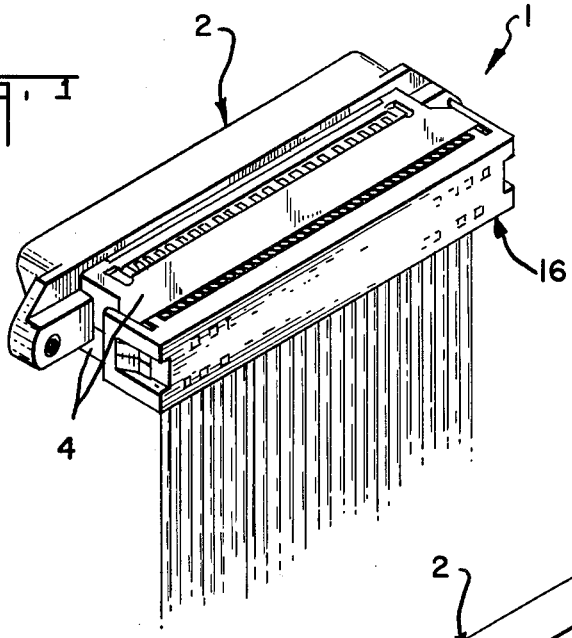
FIG. 1 is a fragmentary perspective of a connector assembly according to the present invention mounted near one end of a flat cable.
Figure 2:
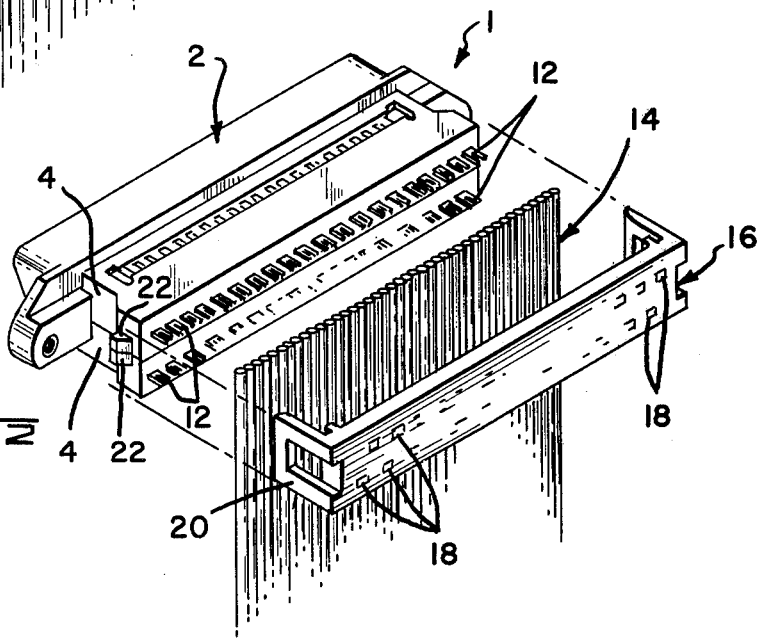
FIG. 2 is a fragmentary perspective of the connector assembly illustrated in FIG. 1 with portions in exploded configuration prior to assembly of the flat cable thereto.
Figure 7:
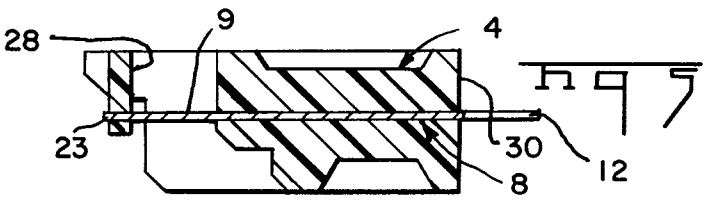
FIGS. 6 and 7 are side elevations of the preferred embodiment of FIG. 1 with parts broken away and in section to illustrate the details thereof, and with portions shown in exploded configuration in FIG. 6.
Figure 6:
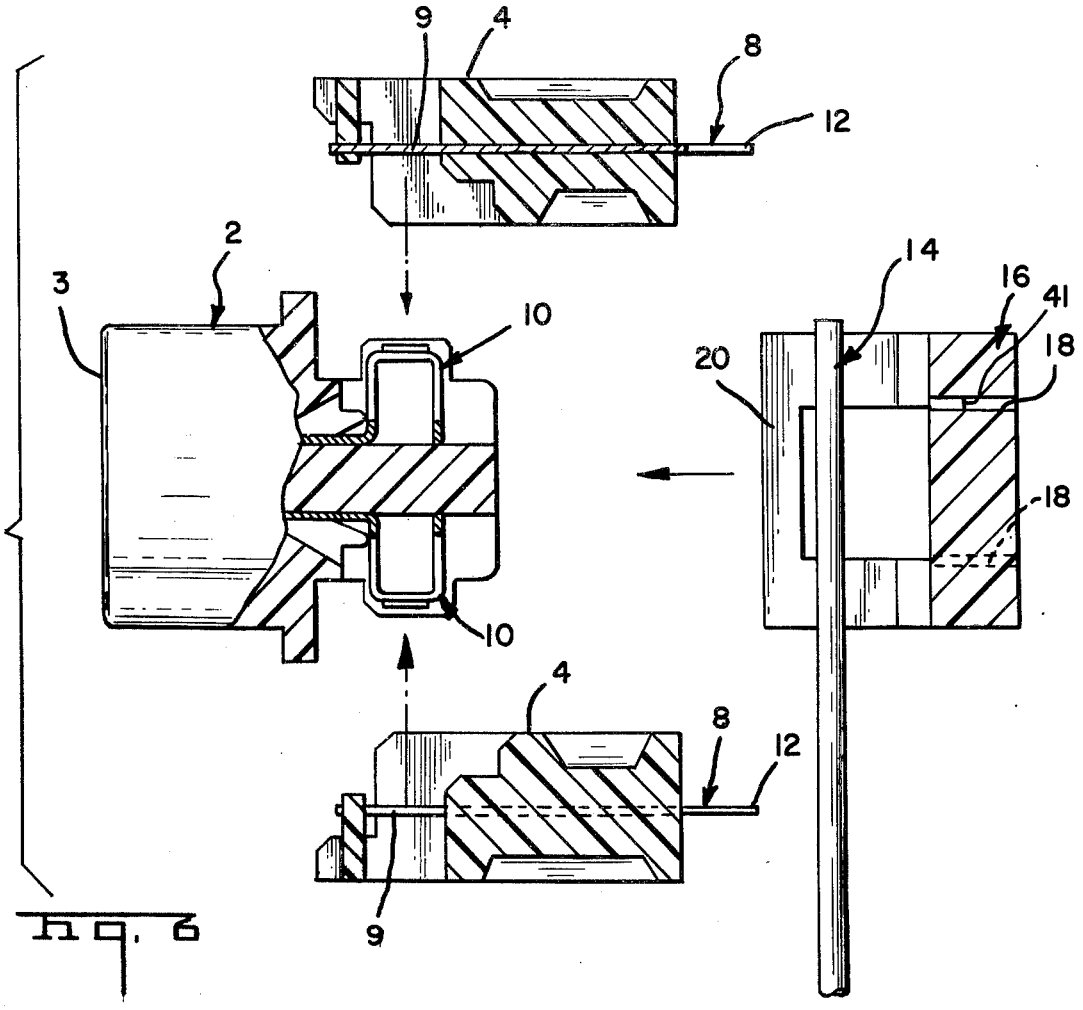
Figure 7:
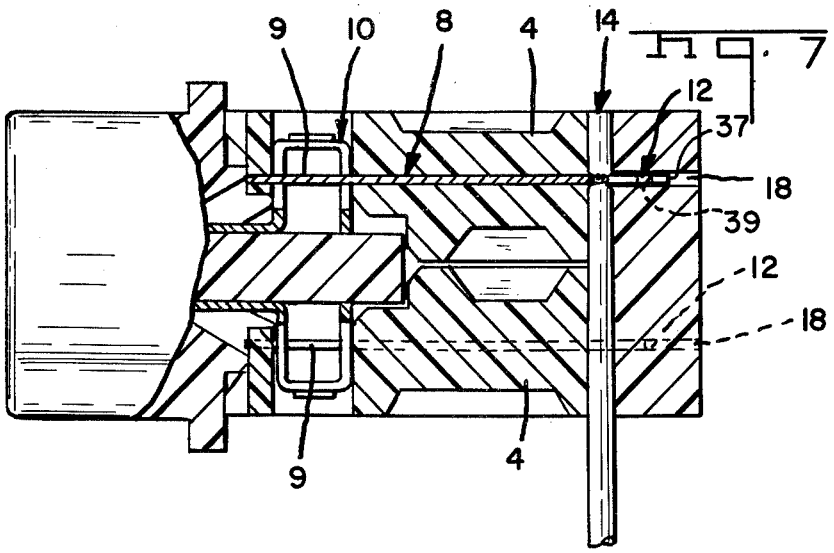

With more particular reference to FIGS. 1, 2, and 6 of the drawings a connector assembly according to the present invention is illustrated generally at 1. The assembly includes an electrical connector generally at 2 having either a plug or receptacle type mating face 3 of the type described in U.S. Pat. No. 3,760,335. The assembly further includes a pair of dielectric strap portions 4 provided with coplanar metal strip circuit traces 8. The straps 4 and 6 are assembled over corresponding rows of contact terminals 10 which project outwardly of opposite sides of the connector, with portions 9 of the circuit traces 8 electrically connected with corresponding terminals 10. Portions of the circuit traces 8 protrude from the straps 4 and 6 as shown at 12. These protruding portions 12 are formed with insulation piercing or penetrating slotted plate contacts 12. A flat cable 14 of the type having parallel conductors individually encased within an insulation jacket is seated against the assembled straps 4 and 6 as shown in FIG. 7. The slotted plate contacts 12 penetrate through the insulation jacket and electrically connect to the individual conductors of the cable 14. A dielectric clasp 16 overlies the cable 14 and is provided with a plurality of recesses 18 in alignment with the contacts 12 for freely receiving portions of the contacts 12 therein when the strap is assembled over the cable 14 and with stiffly resilient clasp portions 20 latchably received over projecting ears 22 on each of the straps 4 and 6.

Figure 4:
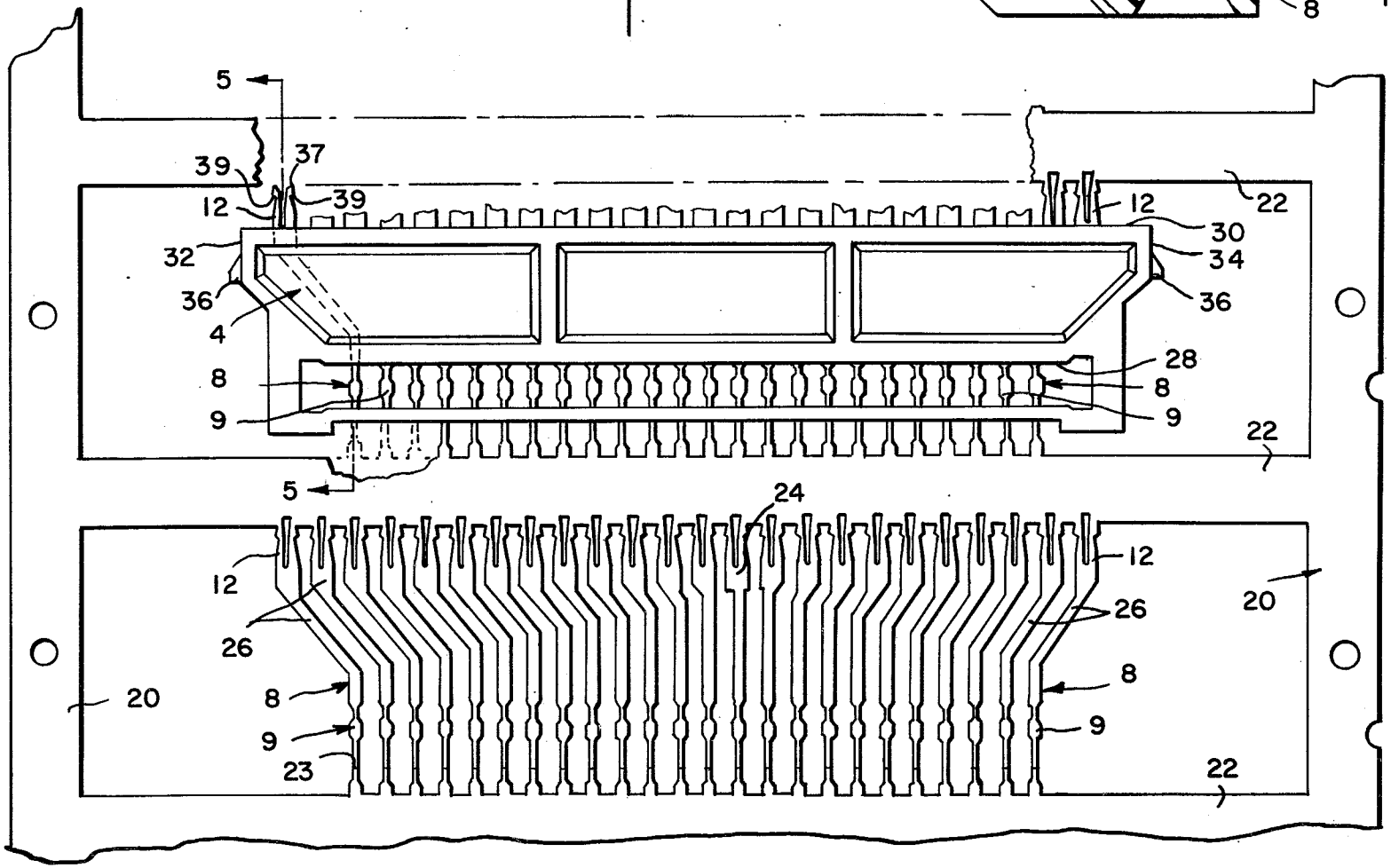
FIG. 4 is an enlarged plan of the stamped and formed circuit traces during phases of manufacturing thereof, the traces remaining integrally with a ladder configuration carrier strip, and insert molded into a rigid dielectric fixture.

As shown more particularly in FIGS. 4 and 5, the metal strip circuit traces 8 are stamped and formed from a larger ribbon of resilient metal strip in such a manner that the circuit traces 8 are arranged in coplanar rows along serially a ladder configuration carrier strip having side strip portions 20 cross connected by strip portions 22. As shown, the portions 9 of the circuit traces 8 are joined to one of these strip portions 22. A score line 23 is provided on each of the strip sections 9 to permit subsequent frangible removal of the strips 8 from the cross strip portion 22. The contact portions 12 similarly are joined frangibly to a cross strip 22. As shown at 24 in FIG. 4, a central one of a row of circuit traces is straight, whereas in the additional circuit traces 8, the contact portions 12 are offset from the contact portions 9 and are integrally joined by diverging or fanned out sections 26. The contact portions 12, therefore, are fanned out on wider centerlines than the centerlines of the contact portions 9.

FIGS. 4 and 5 considered together illustrate another, preceding row of circuit traces 8 on the carrier strip being embedded in rigid dielectric formed into a strap 28 by a process such as injection molding. The strap 28 includes an elongated open slot portion 30 exposing the row of circuit trace portions 9. As shown in FIG. 5, the circuit trace portions 9 bridge across the slot 30 from one side to the other and are embedded in the dielectric on opposite sides of the slot 30 whereby the circuit trace portions 9 are rigidly held by the dielectric in coplanar relationship throughout the length of the circuit traces 8. The strap 28 further is provided with an elongated planar sidewall 32 from which the row of slotted plate contacts 12 protrude. When the circuits 8 are imbedded in the strap 28, they are subsequently separated from the carrier strip portions 22 and are thereby ready for assembly to the connector as shown in FIGS. 6 and 7.

Figure 3:
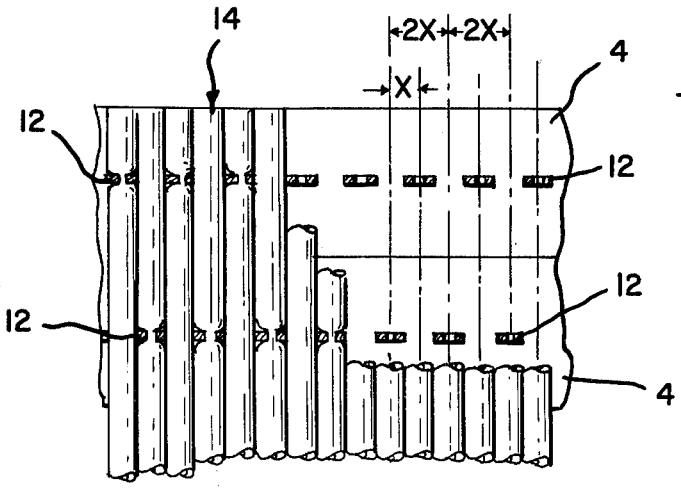
FIG. 3 is an enlarged diagrammatic view illustrating two planes of circuit traces and their connection to the flat cable.

As shown more particularly in FIG. 4, the row of contacts 12 are offset toward, or spaced closer to, one end wall 32 of the strap 4. And the contacts are thereby spaced relatively further from an opposite end wall 34. When two of the straps 4 are assembled to the connector 2 as shown in FIGS. 6 and 7, the contacts 12 of one row are offset or staggered with respect to contacts 12 of the other row. As shown in FIG. 3, contacts 12 of any one row will penetrate the insulation of the cable 14 and electrically grip alternate ones of the conductors. Thereby if x represents the centerline spacing between adjacent conductors, the spacing between adjacent contacts 12 of any one row is represented by 2x.

Any desired form of slotted plate contact which has slicing edges for penetrating, may be utilized. One suitable contact is of the configuration shown in U.S. Pat. No. 3,820,055, which configuration may be stamped and formed integral with each of the circuit traces 8. Such a contact has a central slot 37, which wedgingly receives a conductor, and outside edges having shoulders 39, which latch onto shoulders 41 provided in the recesses 18 of the clasp 16.

Figure 8:
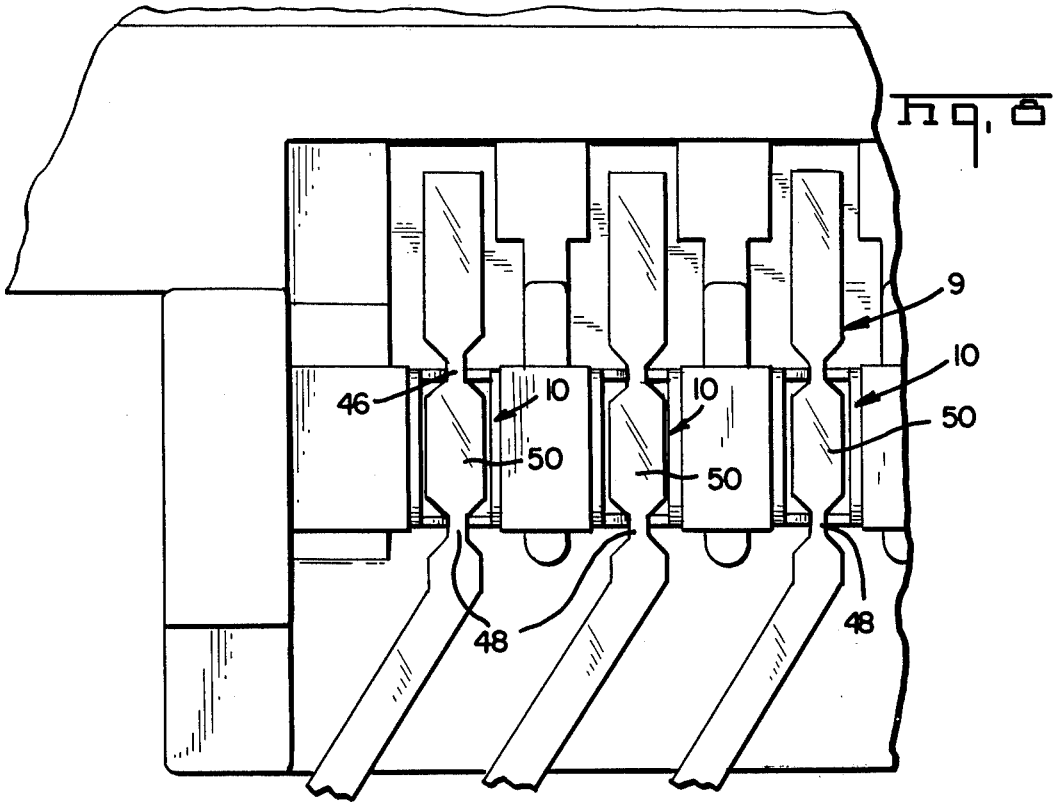
FIG. 8 is a fragmentary enlarged plan of slotted plate sections of a connector with corresponding circuit traces wedgingly connected thereto.
Figure 9:
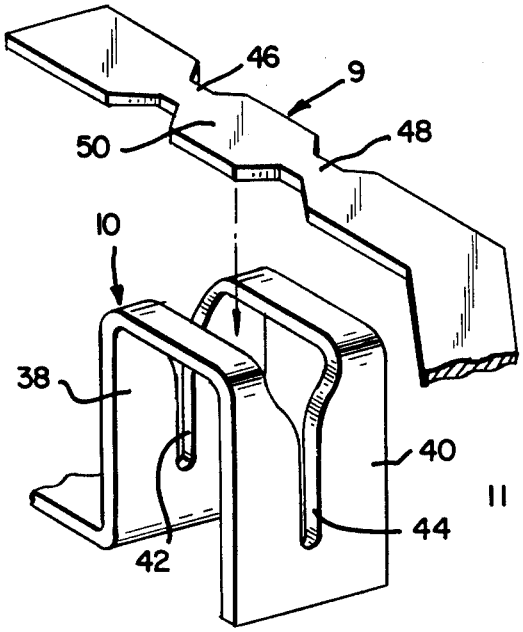
FIG. 9 and FIG. 10 are enlarged fragmentary perspectives of the slotted plate sections of the connector, together with the circuit traces shown in exploded configuration in FIG. 9, and assembled to the plate sections as shown in FIG. 10.
Figure 10:
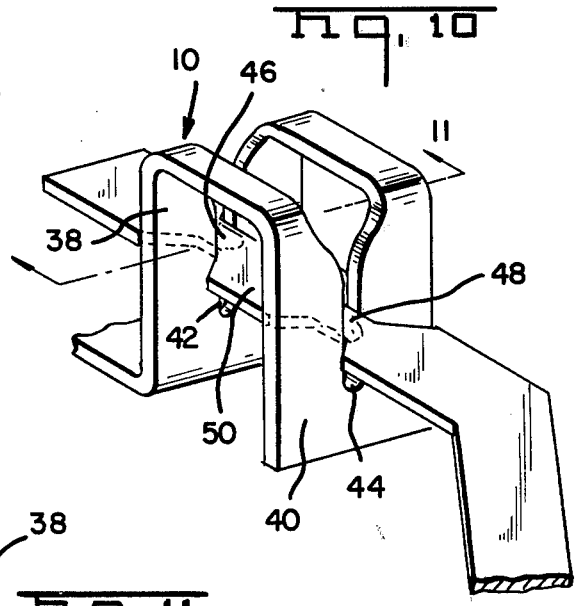

As shown more particularly in FIGS. 8, 9, and 10, each contact terminal 10 is of the type having a pair of spaced parallel plate sections 38 and 40 provided with corresponding slots 42 and 44 which are aligned and which open through an outwardly projecting edge of the plates 38 and 40. Each circuit trace portion 9 includes a pair of narrow waist portions 46 and 48 on either side of a relatively wide section 50. The narrow waist sections 46 and 48 are wedgingly inserted into the corresponding slots 42 and 44 and bridge across the sides of the corresponding slots without buckling or twisting. This is accomplished by providing the portion 50 which is received in the space between the plates 38 and 40. The widened portion 50 serves to butruss the narrow waist portions 46 and 48, preventing their twisting or buckling when received in the slots 42 and 44. Despite the thinness of the metal strip from which the circuit trace portions 9 are formed, and despite the relatively narrow widths of the narrow waist portions, the narrow waist portions wedgingly engage and bridge across the sides of the slots without buckling or twisting. In addition, the section 50 provides a relatively large bearing surface to allow entry of a stuffer tool into the slot 28 on each strap to forcibly urge the circuit trace portions 9 into wedged connection without causing buckling or twisting of the narrow waist portions.

Figure 11:
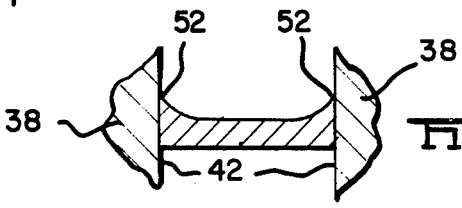
FIG. 11 is a fragmentary elevation of a plate section of a contact terminal with a circuit trace inserted.

As shown in FIG. 11, which is a fragmentary elevation of a plate section of a contact terminal with a circuit trace inserted, the width of the narrow waist portion is an interference fit from side to side of the terminal slot. As a consequence, scraping of the narrow waist portion occurs when it is forced wedgingly along in the slot. The sides may also have a burr 52 scraped upwardly as the waist portion is inserted downwardly in the slot. The burr is an indication that sufficient wiping contact is made to assure electrical continuity between each terminal plate section and a circuit trace.

Although a preferred embodiment of the present invention is disclosed and described in detail, other modifications and embodiments thereof which would be obvious to one having ordinary skill in the art is intended to be covered by the spirit and scope of the appended claims.

What is claimed is:

1. A connector assembly for flat cable, comprising:

a connector housing having a mating side and first and second rows of electrical terminals each having a pair of slotted plate portions separated by a space, first and second rows of coplanar metal strip circuit traces mounted in corresponding first and second dielectric straps, said straps being mounted to said connector over said first and second rows of contacts, each said circuit traces having first and second narrow waist sections wedgingly engaged in said slotted plate portions, each said strip circuit traces having a relatively wide section integral with and disposed between said first and second narrow waist sections and received in the spaces between said plate portions, said strip circuit traces having first and second rows of integral slotted plate contacts having piercing edges, a flat cable having an insulation jacket pierced by said first and second rows of slotted plate contacts, and said flat cable having conductors electrically connected in said slotted plate contacts, and means covering said cable and latched to said first and second straps.

2. In a connector having a housing and first and second rows of electrical contact terminals projecting outwardly toward opposite sides of said housing, with each terminal having a pair of spaced plate sections having aligned slots communicating with outwardly projecting edges of the plate sections, the improvement comprising:

a pair of dielectric straps overlying corresponding rows of terminals, each said strap provided with a plurality of coplanar metal strip circuit traces having first portions wedgingly connected without buckling or twisting in said slots of said plate sections, said circuit traces having second end portions provided with slotted plate contacts projecting outwardly of a corresponding strap, said circuit traces further having mutually diverging portions integrally joined between said first and said second end portions, a flat flexible cable seated against said straps with said contacts penetrating said cable and electrically connected to conductors of said cable, and means latched to said straps for holding said cable seated against said straps.

3. A structure as recited in claim 2, wherein, said straps each include a slot portion receiving a corresponding row of terminals, said circuit traces being exposed in said slots by a stuffer tool entering the slot to engage said circuit traces and wedgingly insert the same in said slots of said plate sections.

4. The structure as recited in claim 2, wherein, said circuit traces include relatively narrow waist portions wedgingly engaged in said slot of said plate sections, and said circuit traces include relatively wide portions integrally connected between said narrow waist portions and received in between said spaced plate sections.

* * * * *